US009184011B2

(12) United States Patent
Jung et al.

(10) Patent No.: US 9,184,011 B2
(45) Date of Patent: Nov. 10, 2015

(54) METHOD OF MANUFACTURING SMALL FUSE

(71) Applicant: SMART ELECTRONICS INC., Ulsan (KR)

(72) Inventors: Jong Il Jung, Busan (KR); Doo Won Kang, Anyang-si (KR); Gyu Jin Ahn, Ulsan (KR); Sang Joon Jin, Busan (KR); Kyung Mi Lee, Ulsan (KR)

( * ) Notice: Subject to any disclaimer, the term of this patent is extended or adjusted under 35 U.S.C. 154(b) by 381 days.

(21) Appl. No.: 13/735,241

(22) Filed: Jan. 7, 2013

(65) Prior Publication Data

US 2013/0118004 A1 May 16, 2013

Related U.S. Application Data

(62) Division of application No. 13/265,751, filed as application No. PCT/KR2010/002500 on Apr. 21, 2010, now abandoned.

(51) Int. Cl.

| | |
|---|---|
| ***H01H 69/02*** | (2006.01) |
| ***H01H 85/165*** | (2006.01) |
| ***H01H 85/17*** | (2006.01) |
| ***H01H 85/041*** | (2006.01) |

(52) U.S. Cl.

CPC ..... *H01H 69/02* (2013.01); *H01H 85/0417* (2013.01); *H01H 85/165* (2013.01); *H01H 85/17* (2013.01); *H01H 2085/0412* (2013.01); *Y10T 29/49107* (2015.01)

(58) Field of Classification Search

CPC ..... H01H 69/02; H01H 69/022; H01H 2069/025; H01H 2069/027; H01H 85/0417; H01H 85/165; H01H 85/17; Y10T 29/49107

See application file for complete search history.

(56) References Cited

U.S. PATENT DOCUMENTS

| | | | |
|---|---|---|---|
| 1,773,184 | A | 8/1930 | Hickey |
| 3,123,696 | A | 3/1964 | McAlister |
| 4,417,226 | A | 11/1983 | Asdollahi et al. |
| 4,612,529 | A | 9/1986 | Gurevich et al. |
| 4,628,293 | A | 12/1986 | Marx |
| 4,899,123 | A | 2/1990 | Asdollahi et al. |
| 5,179,436 | A | 1/1993 | Asdollahi et al. |
| 5,287,079 | A | 2/1994 | Bernardi et al. |
| 6,542,063 | B2 | 4/2003 | Kawashima et al. |
| 6,762,670 | B1 | 7/2004 | Yen |
| 6,930,585 | B2 | 8/2005 | Kawazoe |
| 6,992,560 | B2 | 1/2006 | Yen |

(Continued)

FOREIGN PATENT DOCUMENTS

| | | |
|---|---|---|
| JP | 2000251610 | 9/2000 |
| KR | 200225095 | 5/2001 |

(Continued)

OTHER PUBLICATIONS

Machine Translation of KR2004-0061182A, obtained Mar. 9, 2015.*

(Continued)

*Primary Examiner* — Livius R Cazan

(74) *Attorney, Agent, or Firm* — Cantor Colburn LLP

(57) ABSTRACT

Disclosed are a small fuse and a method of manufacturing the same. A cover made from thermosetting resin is coupled with is a base to receive a fusing element therein. The fusing element does not cause damage to the cover even if the fusing element makes contact with an inner wall of the cover due to size reduction of the cover.

2 Claims, 7 Drawing Sheets

(56) References Cited

U.S. PATENT DOCUMENTS

| | | | | |
|---|---|---|---|---|
| 7,808,362 | B2 | 10/2010 | Stanek et al. | |
| 8,154,376 | B2 | 4/2012 | Aberlin et al. | |
| 2005/0102823 | A1 * | 5/2005 | Kim | 29/623 |
| 2008/0272877 | A1 | 11/2008 | Kwon | |
| 2009/0108980 | A1 | 4/2009 | Whitney et al. | |

FOREIGN PATENT DOCUMENTS

| | | | |
|---|---|---|---|
| KR | 20040061182 | A * | 4/2004 |
| KR | 1020040061182 | | 7/2004 |
| KR | 100527854 | | 11/2005 |
| KR | 1020080081793 | | 9/2008 |
| TW | I267098 | | 11/2006 |

OTHER PUBLICATIONS

International Search Report—PCT/KR2010/002500 dated Nov. 29, 2010.

Notice of Decision to Grant (KIPO) dated Mar. 31, 2011.

Taiwanese Office Action—Taiwanese Application No. 099111931 issued on Oct. 25, 2012, citing KR200225095 and TW I267098.

* cited by examiner

METHOD OF MANUFACTURING SMALL FUSE

TECHNICAL FIELD

The disclosure relates to a small fuse and a method of manufacturing the same. More particularly, the disclosure relates to a small fuse and a method of manufacturing the same, in which the small fuse is mounted on a printed circuit board (PCB) of an electronic product such that a fusing element provided in the small fuse is melted to prevent parts on the PCB from being damaged by shutting off current when over current is applied to the PCB, thereby preventing circuits of the PCB from being damaged.

BACKGROUND ART

In general, higher voltage may be applied to electronic products, such as communication devices connected to telephone circuits, when surge current caused by induction lightning is applied to the electronic products or telephone lines make contact with power lines. For this reason, a fuse used in the communication device must have time lag characteristics to endure against the surge current caused by the induction lightning as well as current blocking characteristics to block current causing malfunction of the communication device.

Recently, as the size of devices has become reduced, the current blocking characteristics and the time lag characteristics are required for the surface-mount type small fuse.

The conventional small fuse includes a base, a pair of lead wires extending by passing through the base while being spaced apart from each other, a fusing element for connecting ends of the lead wires to each other, and a cover coupled with the base to receive the fusing element and the lead wires therein.

The fusing element and the lead wires are made from an alloy of copper and tin so that they have flexibility so as to be bent easily. The base and the cover are individually manufactured by using thermoplastic resin and then coupled with each other to define a space therebetween to receive the fusing element and end portions of the lead wires adjacent to the fusing element.

The small fuse is mounted on the PCB of the electronic product through the lead wires extending out of the base and the fusing element of the small fuse is melted when the over current is applied to the PCB, thereby protecting circuits of the PCB.

SUMMARY OF THE INVENTION

However, the conventional small fuse represents following disadvantages.

Since the size of the small fuse is determined according to the size of the cover and the base, the size of the cover and the base must be minimized to reduce the size of the small fuse such that the size of the electronic product employing the small fuse can be reduced. However, if the size of the cover and the base is reduced, the size of the space formed between the cover and the base to receive the fusing element is also reduced. Thus, if the lead wires adjacent to the fusing element are bent due external impact applied thereto while the base is being coupled with the cover, the fusing element makes contact with an inner wall of the cover. In this case, the cover made from the thermoplastic resin may be damaged by heat generated from the fusing element, so that the small fuse may malfunction. In this regard, it is very difficult to minimize the size of the small fuse.

Accordingly, it is an aspect of the disclosure to provide a small fuse, which can be easily manufactured in a small size without degrading the reliability of the product, and a method of manufacturing the same.

Additional aspects and/or advantages of the disclosure will be set forth in part in the description which follows and, in part, will be apparent from the description, or may be learned by practice of the disclosure.

The foregoing and/or other aspects of the disclosure are achieved by providing a small fuse comprising a base, a pair of lead wires extending by passing through the base while being spaced apart from each other, a fusing element interconnecting end portions of the lead wires adjacent to the base, and a cover including thermosetting resin and coupled with the base to receive the fusing element and the lead wires adjacent to the base.

The cover is integrally coupled with the base through an injection molding process.

The base is formed with a perforation hole positioned corresponding to the fusing element and an interior of the cover is communicated with an exterior of the cover through the perforation hole.

The base may include thermosetting resin.

The cover is individually formed and coupled with the base.

The base may include thermoplastic resin.

The cover has a hollow box shape having one end being open and is press-fitted with the base such that the open end of the cover surrounds an outer peripheral surface of the base, and the base restricts deformation of the cover when the base is coupled with the cover.

The base is provided at the outer peripheral surface thereof with contraction grooves to induce contraction of the base.

The cover has a hollow box shape having one end being open and is press-fitted with the base such that the open end of the cover surrounds an outer peripheral surface of the base, and the open end of the cover is screw-coupled with the outer peripheral surface of the base.

The fusing element makes contact with an inner wall of the cover when the lead wires are inclined toward the inner wall of the cover.

According to another aspect, there is provided a method of manufacturing a small fuse having a base, a pair of lead wires extending by passing through the base while being spaced apart from each other, a fusing element interconnecting end portions of the lead wires adjacent to the base, and a cover including thermosetting resin and coupled with the base to receive the fusing element and the lead wires adjacent to the base, the method comprising installing the lead wires connected to each other by the fusing element on the base and integrally forming the cover with the base through an injection molding process by injecting thermosetting resin molten material into a cavity of a mold in a state in which the fusing element and a portion of the base adjacent to the fusing element are exposed to an interior of the cavity of the mold.

The base is formed with a perforation hole positioned corresponding to the fusing element, the cavity is communicated with an exterior of the base through the perforation hole, and air is injected into the cavity through the perforation hole to prevent the thermosetting resin molten material from approaching to the fusing element.

The mold is formed with injection ports to inject the thermosetting resin molten material and the injection ports are arranged to prevent the thermosetting resin molten material from being directly injected toward the fusing element.

ADVANTAGEOUS EFFECTS

As described above, according to the small fuse and the method of manufacturing the same of the disclosure, the cover made from thermosetting resin is coupled with the base to receive the fusing element therein, so that the cover can be prevented from being damaged by the fusing element even if the fusing element makes contact with the inner wall of the cover due to size reduction of the cover. Accordingly, the small fuse can be manufactured in a small size without degrading the reliability of the product.

BRIEF DESCRIPTION OF THE DRAWINGS

These and/or other aspects and advantages of the disclosure will become apparent and more readily appreciated from the following description of the embodiments, taken in conjunction with the accompanying drawings of which.

DETAILED DESCRIPTION OF THE INVENTION

Figure 1:
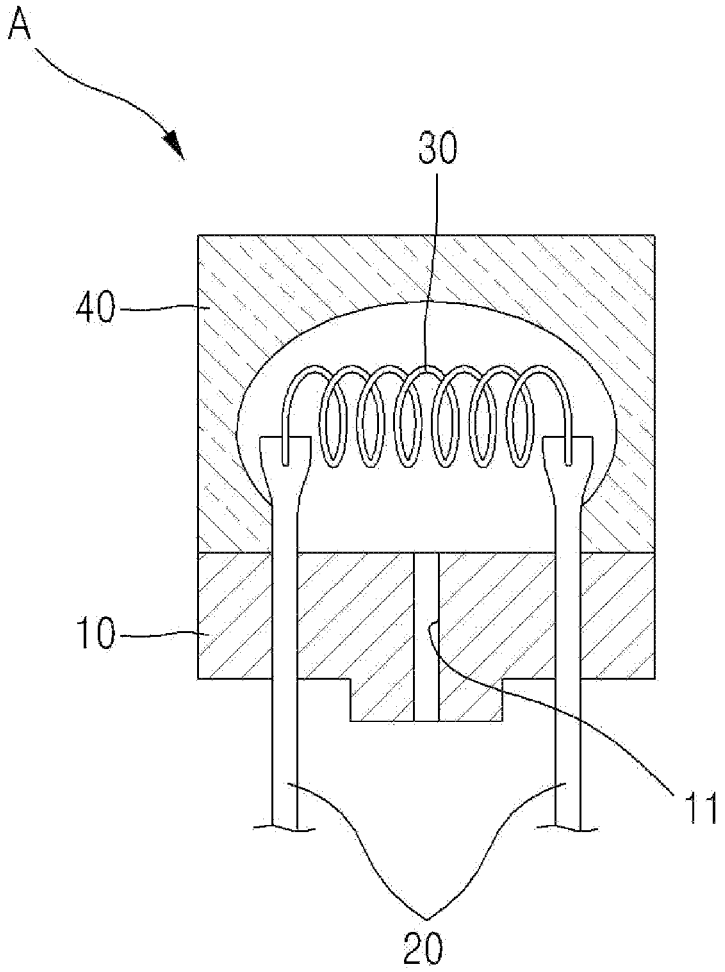
FIG. 1 is a front sectional view showing the structure of a small fuse according to one embodiment.

Reference will now be made in detail to the embodiments of the disclosure, examples of which are illustrated in the accompanying drawings, wherein like reference numerals refer to the like elements. The embodiments are described below to explain the disclosure by referring to the figures.

Figure 2:
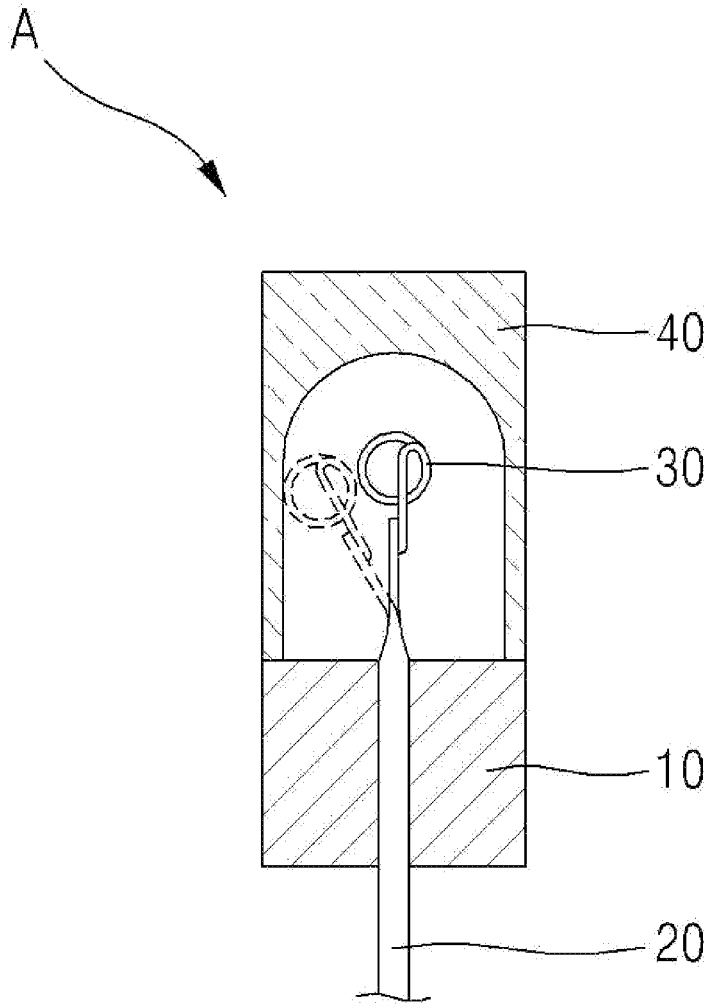
FIG. 2 is a side sectional view showing the structure of a small fuse according to one embodiment.

As shown in FIGS. 1 and 2, a small fuse A includes a base 10, a pair of lead wires 20 extending by passing through the base 10 while being spaced apart from each other, a fusing element 30 for connecting ends of the lead wires 20 to each other, and a cover 40 coupled with the base 10 to receive the fusing element 30 and the lead wires 20 therein.

The fusing element 30 and the lead wires 20 are made from an alloy of copper and tin so that they have flexibility so as to be bent easily. The base 10 and the cover 40 receive the fusing element 30 therein in such a manner that particles generated when the fusing element 30 is melted can be prevented from scattering toward other parts on the PCB adjacent to the small fuse A, thereby preventing peripheral devices from being damaged when the fusing element 30 is melted. The fusing element 30 can be welded to the ends of the lead wires 20.

The small fuse A is mounted on the PCB of the electronic product through the lead wires 20 extending out of the base 10 and the fusing element 30 of the small fuse A is melted when the over current is applied to the PCB, thereby protecting circuits of the PCB. The lead wires 20 can be soldered to the PCB when the small fuse A is mounted on the PCB.

Meanwhile, the small fuse A according to the present embodiment can be manufactured in a small size without degrading the reliability of the product due to the material property of the cover 40, which will be described below in more detail.

According to the small fuse A of the present embodiment, the cover 40 has a hollow box shape, in which one end of the cover 40, that is, a bottom portion of the cover 40 is open. In order to allow the small fuse A to have a small size, an internal space of the cover 40 has a small size to the extent that the fusing element 30 makes contact with an inner wall of the cover 40 if the lead wires 20 are inclined to the inner wall of the cover 40.

Since the cover 40 substantially receives the fusing element 30 therein, if the internal space of the cover 40 is reduced, the whole size of the cover 40 can be reduced. If the whole size of the cover 40 is reduced, the size of the base 10, which is coupled with the cover 40, can also be reduced, so that the whole size of the small fuse A can be reduced. For reference, the virtual line shown in FIG. 2 represents the fusing element 30 making contact with the inner wall of the cover 40 due to deformation of the lead wires 20.

If the internal space of the cover 40 has a small size so that the fusing element 30 makes contact with the inner wall of the cover 40 when the lead wires 20 are inclined to the inner wall of the cover 40, the fusing element 30 makes contact with the inner wall of the cover 40 if external impact is applied to the lead wires 20 adjacent to the fusing element 30 while the base 10 is being coupled with the cover 40 or before the base 10 is coupled with the cover 40. Thus, the cover 40 is damaged by heat generated from the fusing element 30, so the product reliability of the small fuse A may be degraded. According to the present embodiment, however, the cover 40 is made from thermosetting resin having superior heat-resistant property, so that the cover 40 is not deformed by the heat generated from the fusing element 30. Therefore, the product reliability of the small fuse A may not be degraded even if the fusing element 30 makes contact with the cover 40.

Although thermosetting resin has superior heat-resistant property as compared with thermoplastic resin, the thermosetting resin represents high rigidity and low flexibility so that the thermosetting resin may be easily broken. Thus, the cover 40 including the thermosetting resin may be easily broken when external impact is applied thereto while the cover 40 is being coupled with the base. To solve this problem, according to the present embodiment, the cover 40 is integrally coupled with the base 10 through injection molding.

Figure 3:
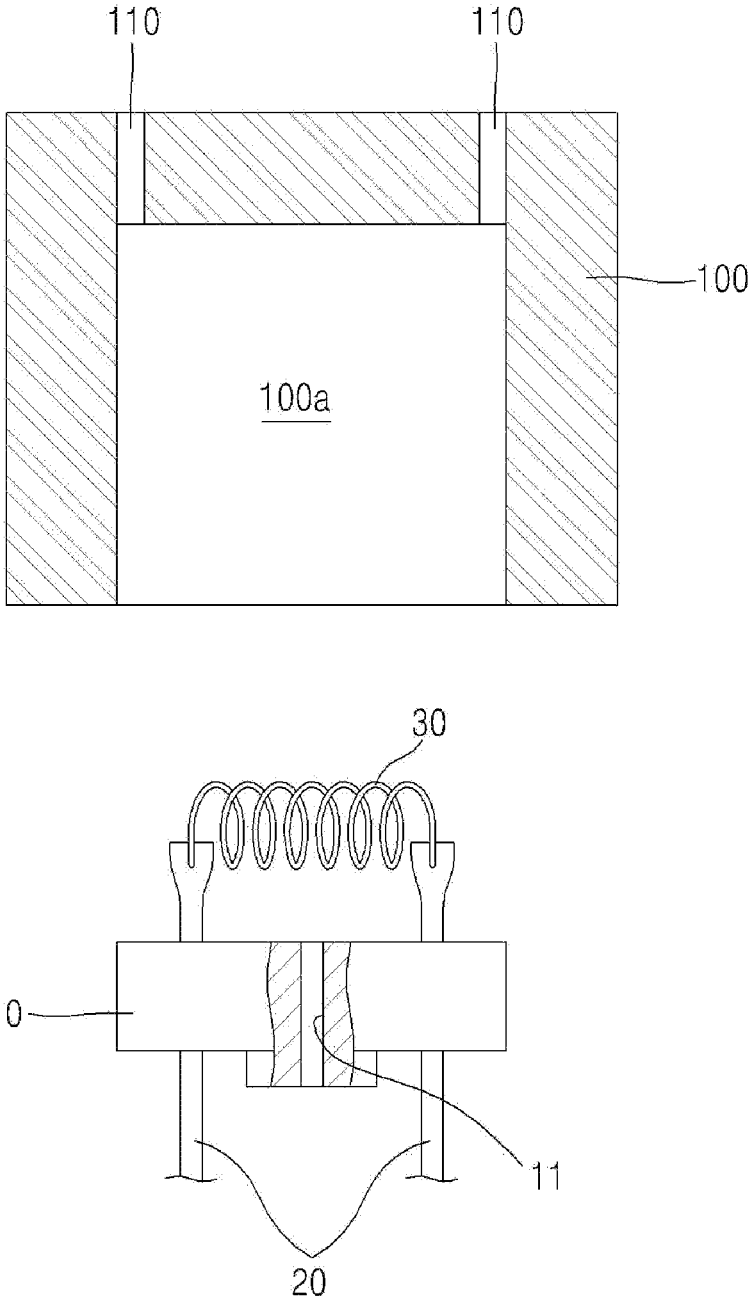
FIG. 3 is a sectional view showing a preparation step in the manufacturing process for a small fuse according to one embodiment.
Figure 4:
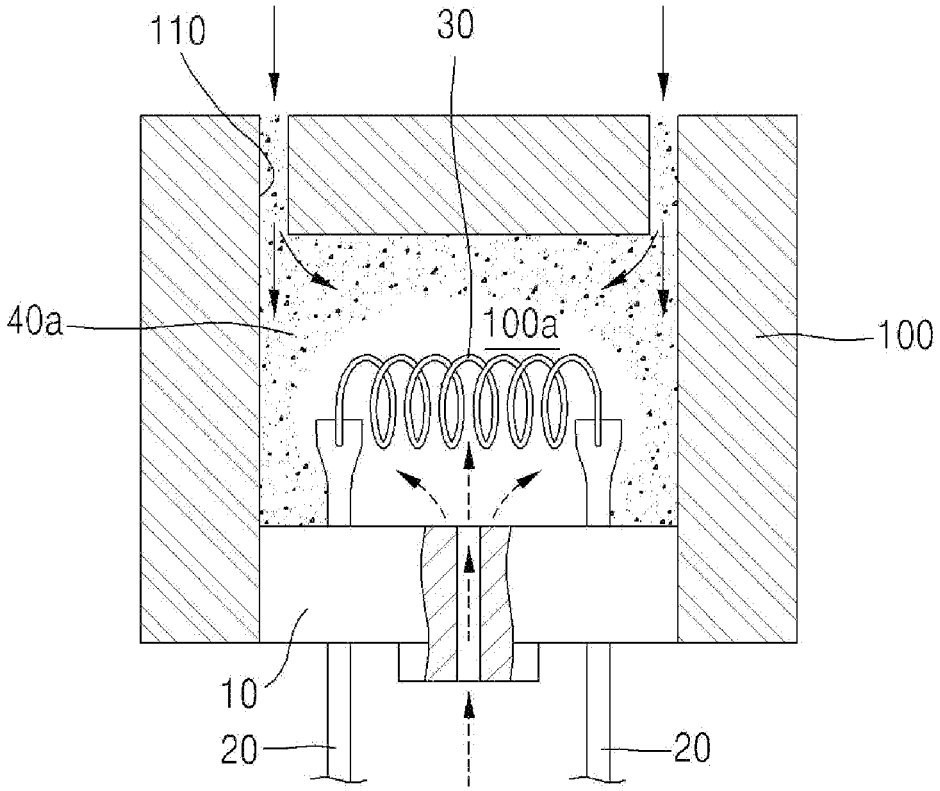
FIG. 4 is a partially sectional view showing an injection molding step in the manufacturing process for a small fuse according to the one embodiment.

FIGS. 3 and 4 show the manufacturing procedure for the small fuse A according to the present embodiment.

In order to manufacture the small fuse A according to the present embodiment, a pair of lead wires 20 connected to each other through the fusing element 30 are installed on the base 10 as shown in FIG. 3, and the cover 40 is integrally formed with the base 10 through the injection molding process by injecting thermosetting resin molten material 40*a* into a cavity 100*a* of a mold 100 in a state in which the fusing element 30 and a portion of the base 10 adjacent to the fusing element 30 are exposed to the interior of the cavity 100*a* of the mold 100 as shown in FIG. 4.

The cavity 100*a* is open toward the base 10 such that the fusing element 30 and the portion of the base 10 adjacent to the fusing element 30 can be introduced into the cavity 100*a*. Injection ports 110 are formed in the mold 100 in opposition to the base 10 such that the thermosetting resin molten material 40*a* can be injected into the cavity 100*a* through the injection ports 110.

Therefore, according to the present embodiment, the thermosetting resin molten material 40*a* for forming the cover 40 directly makes contact with the surface of the base 10 when forming the cover 40 through the injection molding process. Thus, the cover 40 can be integrally formed with the base 10 as the thermosetting resin molten material 40*a* is dried, so that the cover 40 can be prevented from being broken although the cover 40 is made from the thermosetting resin which can be easily broken. If the base 10 comes into contact with the thermosetting resin molten material 40*a* used for forming the cover 40, the base 10 may be damaged by the thermosetting resin molten material 40*a* having the high temperature. Thus, the base 10 is made from the thermosetting resin having superior heat-resistant property.

In addition, if the thermosetting resin molten material 40*a* is injected into the cavity 100*a* of the mold 100 in a state in which the fusing element 30 has been introduced into the cavity 100*a* of the mold 100, the thermosetting resin molten material 40*a* may stick to the fusing element 30 so that the melting performance of the fusing element 30 may be degraded. In this regard, the thermosetting resin molten material 40*a* is prevented from approaching to the fusing element 30 during the injection molding process.

To this end, the base 10 is formed with a perforation hole 11 through which the cavity 100*a* is communicated with the outside of the base 10. In addition, when the thermosetting resin molten material 40*a* is injected into the cavity 100*a* of the mold 100, high-pressure air is sprayed toward the fusing element 30 through the perforation hole 11 to prevent the thermosetting resin molten material 40*a* from approaching to the fusing element 30.

Since the fusing element 30 is installed corresponding to the center of the base 10, the perforation hole 11 is located at the center of the base 10 corresponding to the position of the fusing element 30 in order to prevent the thermosetting resin molten material 40*a* from approaching to the fusing element 30. Arrows with solid lines shown in FIG. 4 indicate the injection direction of the thermosetting resin molten material 40*a*, and arrows with dotted lines indicate the air supply direction.

A gap may not be formed between the base 10 and the cover 40 if the cover 40 is integrally formed with the base 10 through the injection molding. Thus, the perforation hole 11 may substitute for the gap formed between the base and the cover in the conventional small fuse. That is, the perforation hole 11 may serve as a discharge path for explosive pressure occurring when the fusing element 30 is melted during the use of the small fuse A, so that the small fuse A can be stably used.

If air having excessive pressure is introduced into the cavity 100*a* through the perforation hole 11, the thermosetting resin molten material 40*a* may not be easily injected into the cavity 100*a*. In this regard, the injection pressure of the thermosetting resin molten material 40*a* introduced into the cavity 100*a* is higher than the pressure of air introduced into the cavity 100*a* through the perforation hole 11 by 10 HPa to 20 HPa.

In addition, in order to effectively prevent the thermosetting resin molten material 40*a* from approaching to the fusing element 30, the injection ports 110 are positioned corresponding to outer sides of the fusing element 30 such that the thermosetting resin molten material 40*a* may not be directly injected toward the fusing element 30. In order to uniformly maintain the injection pressure in a state in which the injection ports 110 are located at outer sides of the cavity 100*a*, other than the center of the cavity 100*a*, a plurality of injection ports 110 are formed in the mold 100 such that the thermosetting resin molten material 40*a* can be simultaneously injected to plural portions of the cavity 100*a* while preventing the thermosetting resin molten material 40*a* from being directly injected toward the fusing element 30.

Figure 5:
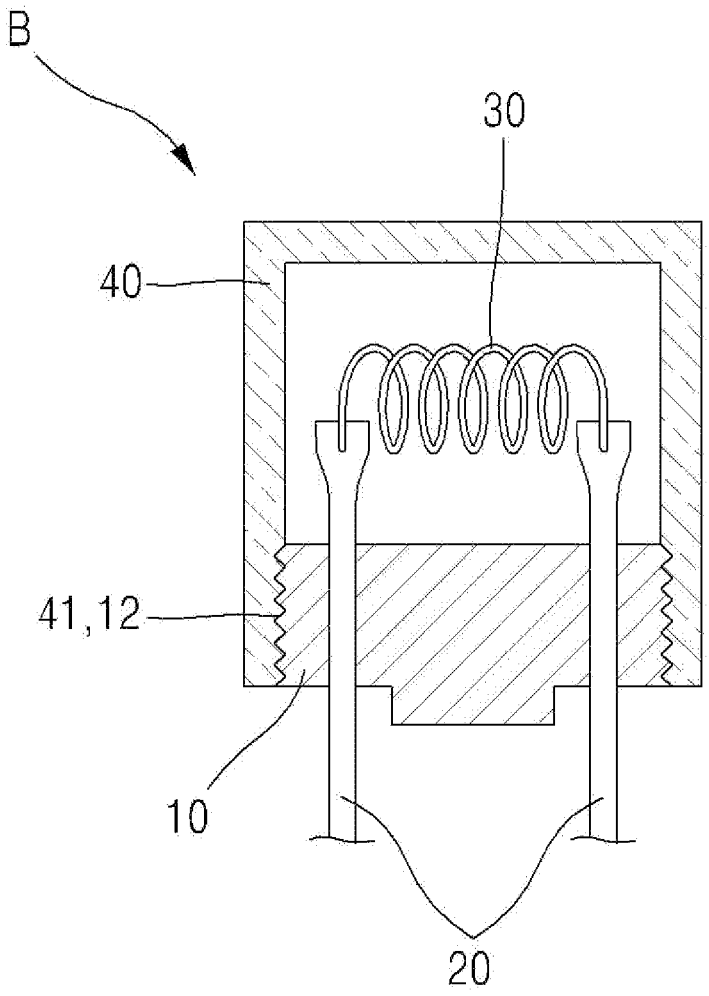
FIG. 5 is a front sectional view showing the structure of a small fuse according to another embodiment.
Figure 6:
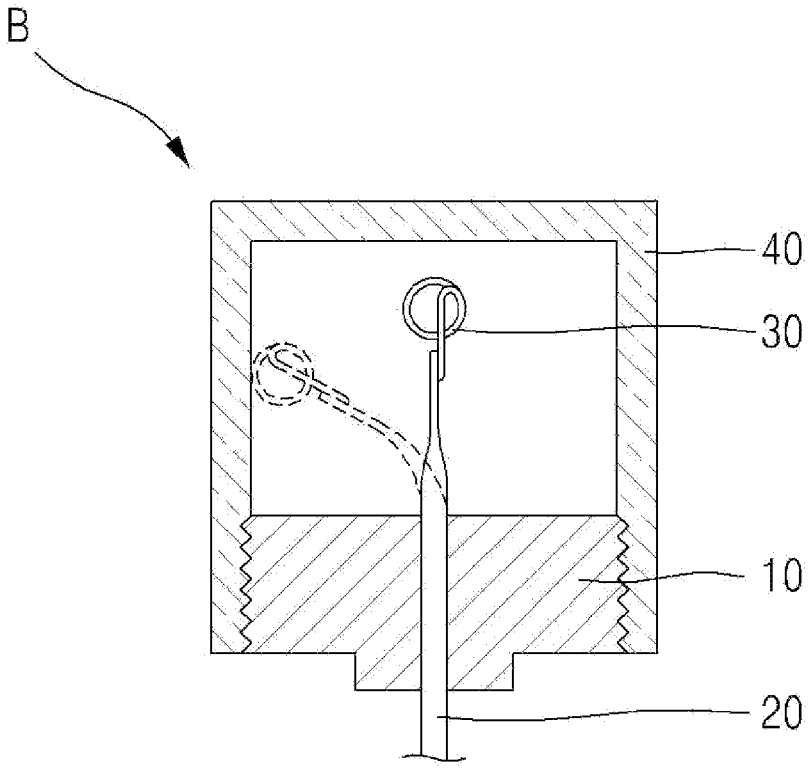
FIG. 6 is a side sectional view showing the structure of a small fuse according to another embodiment.

FIGS. 5 and 6 show the structure of a small fuse B according to another embodiment.

In this embodiment, the cover 40 of the small fuse B is made from thermosetting resin. This embodiment is different from the previous embodiment in that the cover 40 and the base 10 are individually formed through the injection molding and then coupled with each other. In addition, the base 10 is made from thermoplastic resin having superior flexibility than the thermosetting resin to prevent the cover 40 from being broken while the cover 40 is being coupled with the base 10.

In more detail, according to the present embodiment, the cover 40 has a hollow cylindrical shape having one end being open and the base 10 has a disc shape having predetermined thickness. The cover 40 is coupled with the base 10 in such a manner that the open end of the cover 40 surrounds an outer peripheral surface of the base 10. That is, the outer peripheral surface of the base 10 is screw-coupled into the open end of the cover 40 such that the cover 40 can be securely coupled with the base 10 while preventing the cover 40 from being broken when the cover 40 is coupled with the base 10. To this end, a female screw 41 is formed at an inner peripheral surface of the open end of the cover 40 and a male screw 12 is formed at the outer peripheral surface of the base 10. In addition, explosive pressure occurring when the fusing element 30 is melted can be discharged through a fine gap formed between the female screw 41 and the male screw 12.

Figure 7:
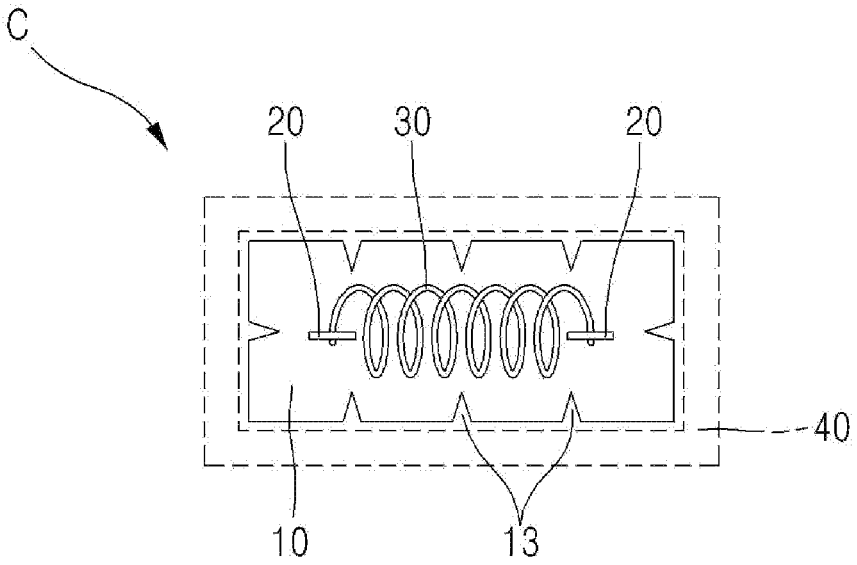
FIG. 7 is a top sectional view showing the structure of a small fuse according to another embodiment.

According to still another embodiment, as shown in FIG. 7, a small fuse C includes the cover 40 made from thermosetting resin and the base 10 made from thermoplastic resin. According to this embodiment, different from the previous embodiment, the cover 40 is coupled with the base 10 through the press-fitting scheme.

That is, according to the present embodiment, the cover 40 has a hollow box shape having one end being open and the open end of the cover 40 surrounds the outer peripheral surface of the base 10 when the cover 40 is coupled with the base 10. At this time, the outer peripheral surface of the base 10 is press-fitted into the open end of the cover 40. In order to prevent the open end of the cover 40 from being expanded, contraction grooves 13 are formed at the outer peripheral surface of the base 10 to induce contraction of the base 10 when the cover 40 is coupled with the base 10.

The contraction grooves 13 are formed along the outer peripheral surface of the base 10 while being spaced apart from each other by a predetermined distance. Each contraction groove 13 is open toward the outside of the base 10 to induce contraction of the outer peripheral surface of the base 10 when the cover 40 is coupled with the base 10. According to the small fuse C of the present embodiment, deformation of the cover 40 can be absorbed by the contraction grooves 13, thereby preventing the cover 40 made from the thermosetting resin from being broken when the cover 40 is coupled with the base 10. The contraction grooves 13 may have various shapes to the extent that they can restrict the deformation of the cover 40. In the case of the small fuse C according to the present embodiment, explosive pressure occurring when the fusing element 30 is melted can be discharged through the contraction grooves 13.

Similar to the small fuse A, the small fuses B and C can also be manufactured in the small size without degrading the reliability of the product due to the material property of the cover 40.

Although few embodiments of the disclosure have been shown and described, it would be appreciated by those skilled in the art that changes may be made in these embodiments without departing from the principles and spirit of the disclosure, the scope of which is defined in the claims and their equivalents.

What is claimed are:

1. A method of manufacturing a small fuse having a base, a pair of lead wires extending by passing through the base while being spaced apart from each other, a fusing element interconnecting end portions of the lead wires adjacent to the base, and a cover including thermosetting resin and coupled with the base to receive the fusing element and the lead wires adjacent to the base, the method comprising:

installing the lead wires connected to each other by the fusing element on the base; and integrally forming the cover with the base through an injection molding process by injecting thermosetting resin molten material into a cavity of a mold in a state in which the fusing element and a portion of the base adjacent to the fusing element are exposed to an interior of the cavity of the mold, wherein the base is formed with a perforation hole positioned corresponding to the fusing element, the cavity is communicated with an exterior of the base through the perforation hole, and air is injected into the cavity through the perforation hole to prevent the thermosetting resin molten material from approaching to the fusing element.

2. A method of manufacturing a small fuse having a base, a pair of lead wires extending by passing through the base while being spaced apart from each other, a fusing element interconnecting end portions of the lead wires adjacent to the base, and a cover including thermosetting resin and coupled with the base to receive the fusing element and the lead wires adjacent to the base, the method comprising:

installing the lead wires connected to each other by the fusing element on the base; and integrally forming the cover with the base through an injection molding process by injecting thermosetting resin molten material into a cavity of a mold in a state in which the fusing element and a portion of the base adjacent to the fusing element are exposed to an interior of the cavity of the mold, wherein the mold is formed with injection ports to inject the thermosetting resin molten material and the injection ports are arranged to prevent the thermosetting resin molten material from being directly injected toward the fusing element.

* * * * *